US008388112B2

(12) United States Patent
Mardilovich et al.

(10) Patent No.: US 8,388,112 B2
(45) Date of Patent: Mar. 5, 2013

(54) PRINTHEAD AND METHOD OF FABRICATING THE SAME

(75) Inventors: Peter Mardilovich, Corvallis, OR (US); Neal Wayne Meyer, Corvallis, OR (US); Arjang Fartash, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 13 days.

(21) Appl. No.: 13/148,601

(22) PCT Filed: Feb. 24, 2009

(86) PCT No.: PCT/US2009/035005

§ 371 (c)(1), (2), (4) Date: Aug. 9, 2011

(87) PCT Pub. No.: WO2010/098743

PCT Pub. Date: Sep. 2, 2010

(65) Prior Publication Data

US 2011/0310182 A1 Dec. 22, 2011

(51) Int. Cl.
*B41J 2/05* (2006.01)
*B21D 53/76* (2006.01)

(52) U.S. Cl. ..... 347/62; 347/56; 29/890.1

(58) Field of Classification Search ..... None
See application file for complete search history.

(56) References Cited

U.S. PATENT DOCUMENTS

| | | | | |
|---|---|---|---|---|
| 4,535,343 | A | 8/1985 | Wright et al. | |
| 7,267,859 | B1 | 9/2007 | Rabin et al. | |
| 7,681,994 | B2 * | 3/2010 | Hoisington et al. | 347/65 |
| 7,703,891 | B2 * | 4/2010 | Shim et al. | 347/62 |
| 8,100,511 | B2 * | 1/2012 | Kim et al. | 347/62 |
| 2003/0010971 | A1 | 1/2003 | Zhang et al. | |
| 2008/0115359 | A1 * | 5/2008 | Guan et al. | 29/890.1 |

FOREIGN PATENT DOCUMENTS

| | | |
|---|---|---|
| JP | 2004-090547 | 3/2004 |
| JP | 2006-062049 | 3/2006 |
| JP | 2007-083591 | 4/2007 |

OTHER PUBLICATIONS

International Search Report and Written Opinion for PCT/US2009/035005 dated Aug. 11, 2009 (13 pages).

* cited by examiner

*Primary Examiner* — Geoffrey Mruk

(57) ABSTRACT

Disclosed is a printhead having at least one ink drop generator region, which includes an ink chamber, an orifice through which ink drops are ejected, and a heating element positioned below the ink chamber. The heating element includes a resistor defined therein and a nano-structured surface that is exposed to the ink fluid supplied to the ink chamber. The nano-structured surface takes the form of an array of nanopillars. The printhead is fabricated by a method that includes: forming a heating element having an oxidizable metal layer as the uppermost layer; forming an aluminum-containing layer on the oxidizable metal layer; anodizing the aluminum-containing layer to form porous alumina; anodizing the oxidizable metal layer so as to partially fill the pores in the porous alumina with metal oxide material; and removing the porous alumina by selective etching to produce a nano-structured surface.

13 Claims, 9 Drawing Sheets

PRINTHEAD AND METHOD OF FABRICATING THE SAME

FIELD OF THE INVENTION

The present invention generally relates to the printhead portion of an inkjet printer.

BACKGROUND

Thermal inkjet printers typically have a printhead for generating ink drops and ejecting them onto a printing medium. The typical inkjet printhead includes: a nozzle plate having an array of orifices that face the paper; ink channels for supplying ink from an ink source, such as a reservoir, to the orifices; and a substrate carrying a plurality of heating resistors, each resistor positioned below a corresponding orifice. Current pulses are applied to the heating resistors to momentarily vaporize the ink in the ink channels into bubbles. The ink droplets are expelled from each orifice by the growth and subsequent collapse of the bubbles. As ink in the ink channels is expelled as droplets through the nozzles, more ink fills the ink channels from the reservoir.

The objects and features of the present invention will be better understood when considered in connection with the accompany drawings. Note that the drawings are schematic, unscaled illustrations and like reference numbers designate like parts throughout.

DETAILED DESCRIPTION

One problem often encountered during ink drop generation is the deposition of ink residues such as pigment ink particles onto the exposed heating surface of the resistors, thereby creating a sticky build-up of residue which adversely affects the printhead performance, and consequently resulting in the degradation of image quality. This problem is often called in the art as Kogation, i.e. a process in which a residue film is formed on the heater surface as the result of repeated heating as well as chemical reactions that take place on the resistor surface. The heating causes the material adhering to heater surface to be baked, and the baked material acts as an insulator that reduces heat transfer to the ink, thereby causing a decrease in thermal transmittance, and consequently changing the characteristics of the ejected ink drops, e.g. lower drop velocity and smaller drop size.

The present invention provides an inkjet printhead having at least one heating element for generating the heat that vaporizes the ink into bubbles, wherein the exposed surface of the heating element has a nano-structured surface for preventing residues, particularly pigment ink particles, from accumulating on the heating surface of the heating element. The heating surface is the surface that is exposed to the ink during bubble generation. The nano-structured surface takes the form of an array of nano-pillars with nanoscale dimensions integrally formed on the uppermost layer of the heating element. The design of such heating element solves the Kogation problem discussed above. Another aspect of the present invention is a method for fabricating the heating element discussed above that is simple, low cost, and effective.

Figure 1:
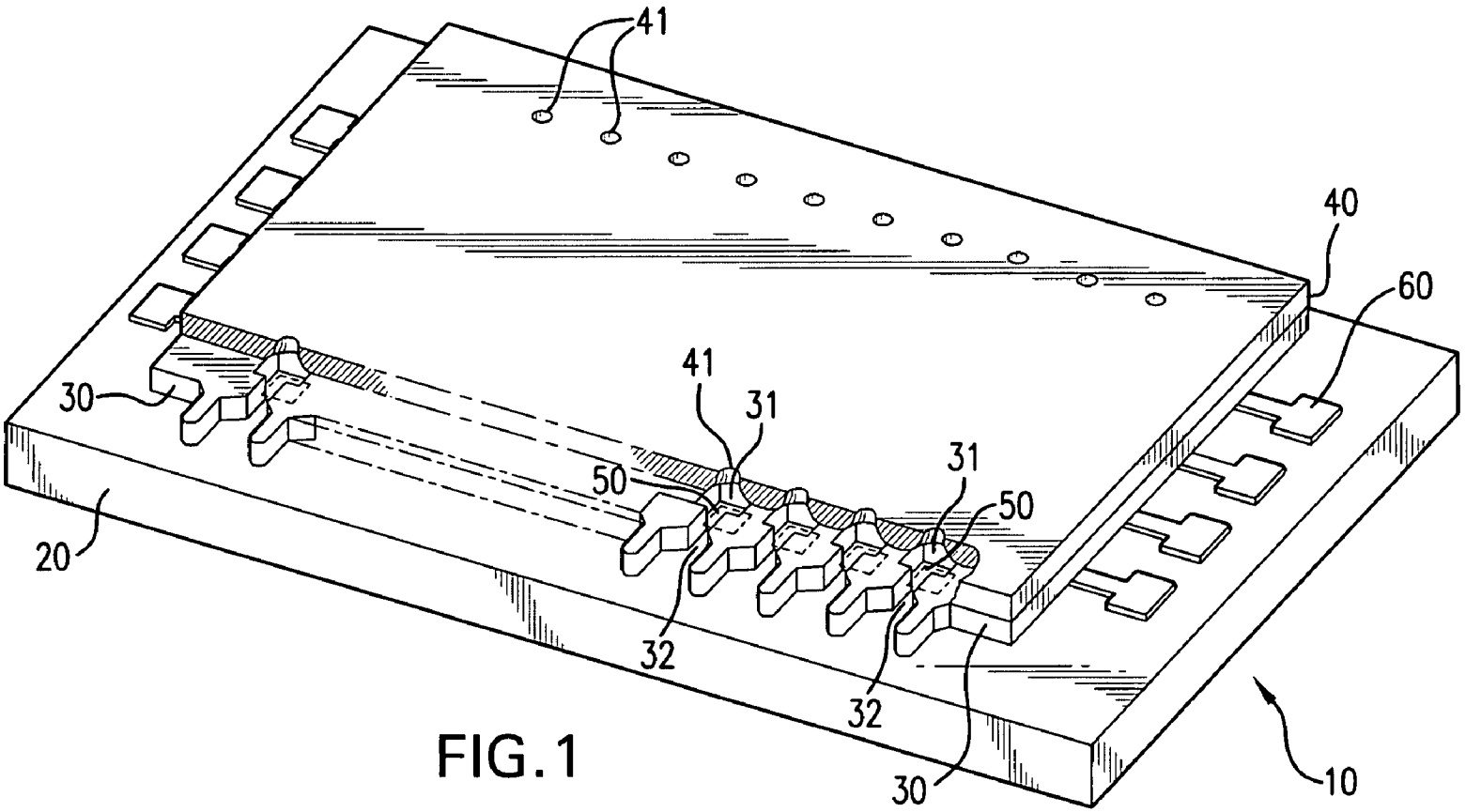
FIG. 1 shows a schematic perspective view of an exemplary inkjet printhead configuration which incorporates the present invention.

FIG. 1 shows a schematic perspective view of an exemplary inkjet printhead 10 which incorporates the features of the present invention. The printhead 10 includes a substrate 20, an ink barrier layer 30 disposed on the substrate 20, and a nozzle plate 40 attached to the top of the ink barrier layer 30. The substrate 20 supports a plurality of heating elements, which are used for generating the heat that vaporize the ink. Defined within these heating elements are resistors 50 (shown by phantom lines). A plurality of ink chambers 31 and ink channels 32 are formed in the barrier layer 30 such that each ink chamber 31 is disposed above an associated resistor 50. In one embodiment, the heating elements are formed using conventional integrated circuit fabrication techniques. The barrier layer 30 is a dry film laminated onto the substrate 20 by heat and pressure after the heating elements are formed on the substrate 20. Subsequently, the ink chambers 31 and ink channels 32 are formed in the barrier layer 30 by photoimaging techniques. By way of example, the barrier material is a photoimageable polymer such as that sold under the trademark Parad obtainable from E.I. DuPont de Nemours and Co. of Wilmington, Del. The nozzle plate 40 includes a plurality of orifices 41 disposed over respective ink chambers 31 such that each ink chamber 31, an associated orifice 41, and an associated resistor 50 are aligned. By way of example, the nozzle plate 40 is made of a polymer material and in which the orifices 41 are formed by laser ablation. As another example, the nozzle plate 40 is made of a plated metal such as nickel. Bonding pads 60, which are connectable to external electrical connections, are formed at the ends of the substrate 20 and are not covered by the ink barrier layer 30. The bonding pads 60 are formed on the substrate 20 by conventional deposition and patterning techniques. By way of example, the bonding pads may be formed of gold. When current pulses are applied to the resistors 50, ink bubbles are formed in the ink chambers 31, and ink droplets are expelled from orifices 41 by the growth of the bubbles. An ink drop generator region is defined by an ink chamber 31, an associated orifice 41, and an associated heating element 50.

Figure 2:
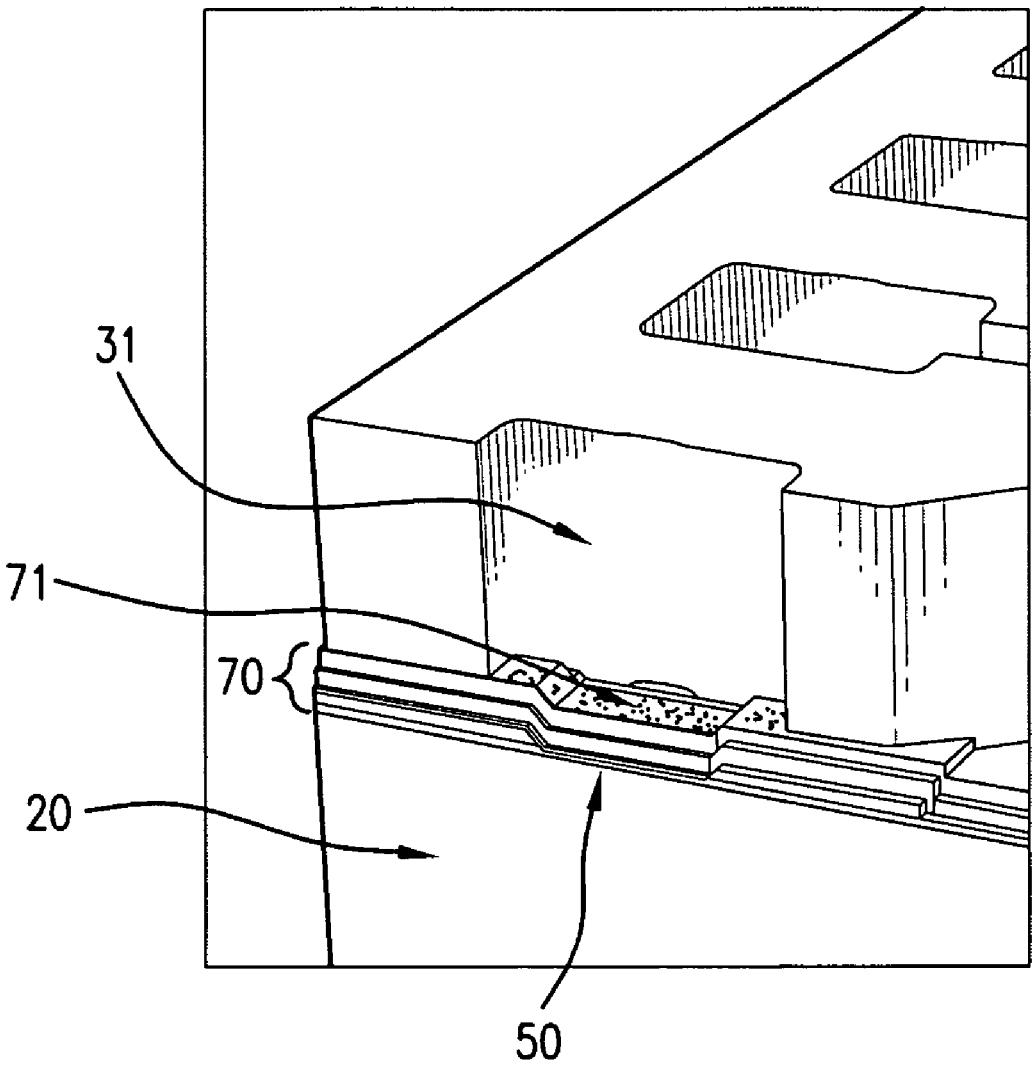
FIG. 2 shows a cross-sectional view of an ink drop generator region of the printhead configuration shown in FIG. 1.

FIG. 2 shows an enlarged, cross-sectional view of a representative ink drop generator region of the printhead described in FIG. 1. In FIG. 2, the nozzle plate 40 has been removed to simplify illustration. Below an ink chamber 31 is an associated heating element, which is composed of a stack of thin films 70. The resistor 50 is defined within the stack of thin films 70. The uppermost layer of the stack 70 serves as a passivation layer for the resistor 50 and has a nano-structured surface 71 that is exposed to the ink fluid supplied to the ink chamber 31.

Figure 3:
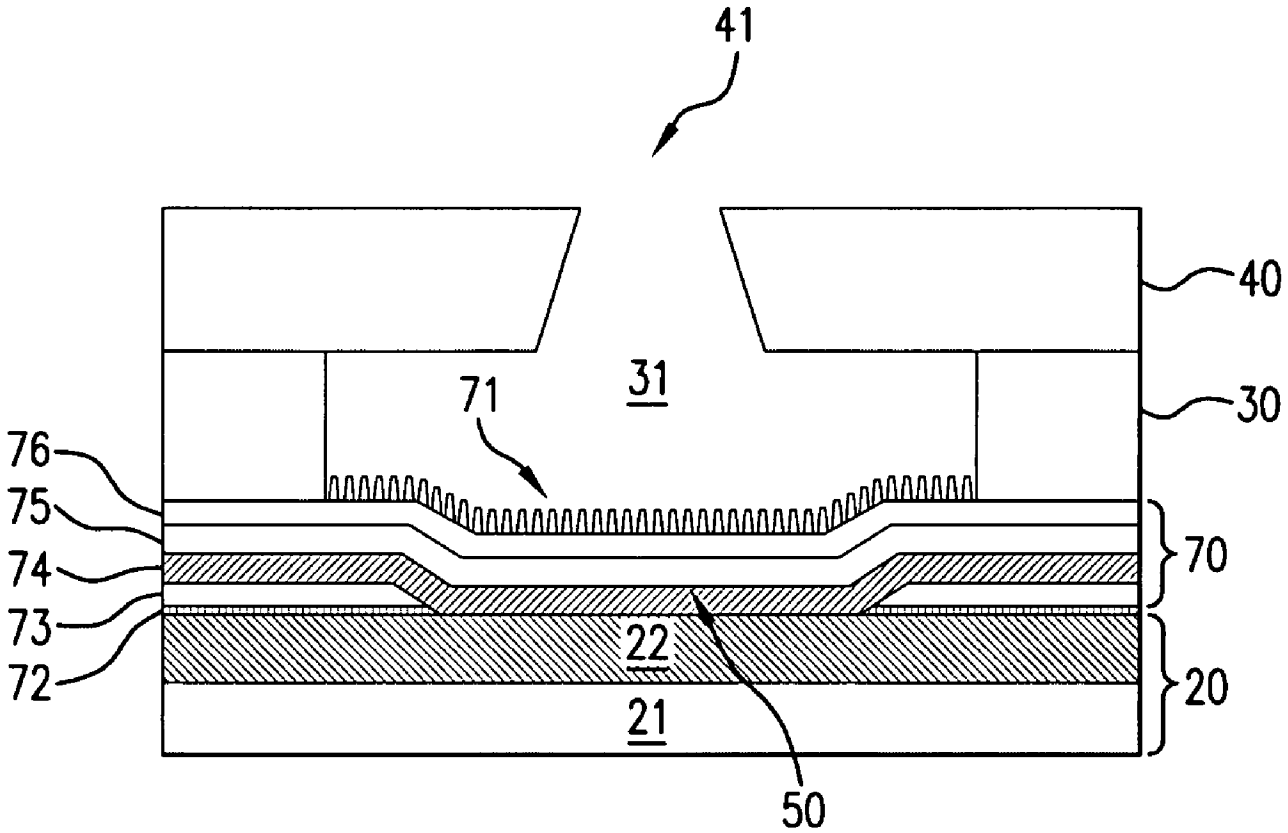
FIG. 3 shows an enlarged, cross-sectional view of a heating element in the ink drop generator region according to an embodiment of the present invention.

FIG. 3 shows an enlarged, cross-sectional view of the ink drop generator region and a specific embodiment for the stack of thin films 70. Referring to FIG. 3, the heating element is composed of a stack of thin films 70, which includes patterned lining layer 72, patterned conductor layer 73, resistive layer 74, insulating passivation layer 75 and a metal passivation layer 76 as the uppermost layer. The uppermost layer 76 is provided with a nano-structured surface 71, which takes the form of an array of nano-pillars. The lining layer 72 and conductor layer 73 are patterned so as to define the resistor area 50. The resistive layer 74 is deposited over the patterned conductor layer 73 and the resistor area 50. By way of example, the lining layer 72 is made of titanium nitride (TiN), the patterned conductor layer 73 is made of Al alloy containing about 0.5% Cu, the resistive layer 74 is made of tungsten-silicon nitride (WSiN). Also by way of example, the insulating passivation layer 75 is a composite of silicon nitride/silicon carbide (SiN/SiC) deposited over the resistive layer 74. The nano-structure surface 71 of the heating element 70 takes the form of an array of nano-pillars integrally formed on the uppermost layer as illustrated in FIG. 3. It is preferred that the nano-pillars cover the entire surface of the uppermost layer 76 that is exposed to the ink fluid supplied to the ink chamber 31, which surface is the heating surface of the heating element 70. Furthermore, the uppermost passivation layer 76 is formed of an oxidizable metal, such as tantalum (Ta), niobium (Nb), titanium (Ti), tungsten (W), or alloys thereof, and the nano-pillars integrally formed on the passivation layer 76 are derived from anodizing such metal. The method for forming the nano-pillars will be described in more detail with reference to FIGS. 4 and 5A-5E.

The heating element described with reference to FIG. 3 is one possible configuration that incorporates the objectives of the present invention. It should be apparent to those skilled in the art that other configurations for the heating element are contemplated. The objectives of the present invention include covering the uppermost layer or exposed surface of the heating element with nano-pillars to prevent build-up on the heating surface of the heating element that is exposed to the ink in the ink chamber. This nano-structured surface is designed to prevent or minimize the build-up of pigment particles from pigment ink, but such surface could also prevent or minimize the build-up of residues from other type of inks.

Figure 4:
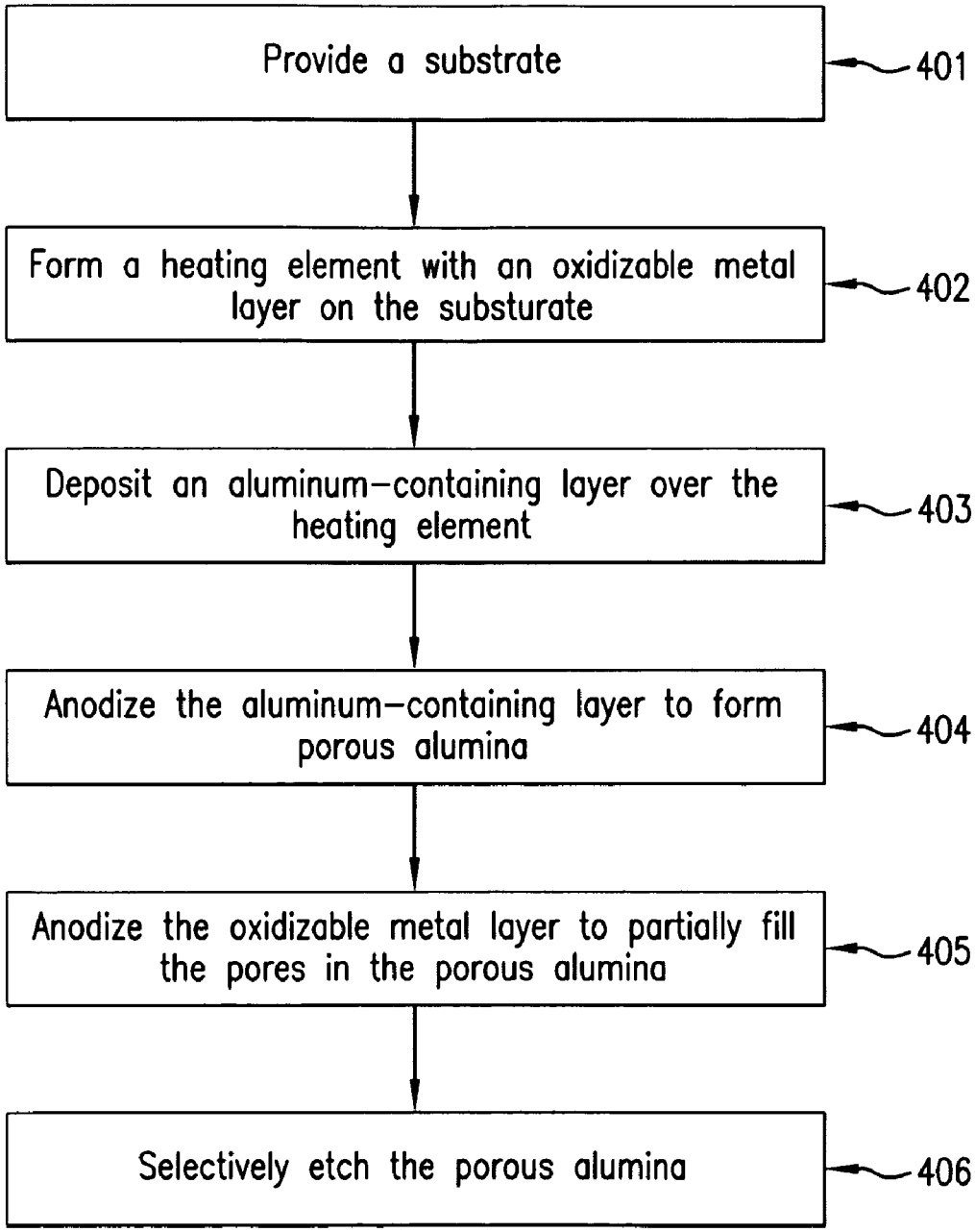
FIG. 4 shows a high-level flowchart of a method for fabricating a heating element having a nano-structured surface according to the present invention.

FIG. 4 shows a high-level flowchart of the method for fabricating the heating element with the nano-structured surface discussed above. At step 401, the method starts with a substrate. At step 402, a heating element is then formed on the substrate. The heating element includes a resistor defined therein and may be a single-layer resistor structure or a multilayered structure having a resistor defined therein. The heating element includes a layer made of an oxidizable metal, preferably refractory metal such as tantalum (Ta), niobium (Nb), titanium (Ti), tungsten (W), or their alloys, as the exposed layer. At step 403, an aluminum-containing layer is deposited over the heating element. The aluminum-containing layer may be pure aluminum or aluminum alloy. Next, at step 404, an anodization process is carried out to anodize the aluminum so as to produce porous aluminum oxide (alumina). The pores in the porous alumina expose portions of the underlying oxidizble metal layer. At step 405, a second anodization process is carried out to anodize the underlying metal layer so that the pores of the aluminum oxide are partially filled from the bottom up with metal oxide material. Subsequently, the porous alumina is removed by selective etching at step 406 to leave behind a nano-structured surface, which takes the form of an array of nano-pillars of anodic metal oxide material.

Figure 5A:
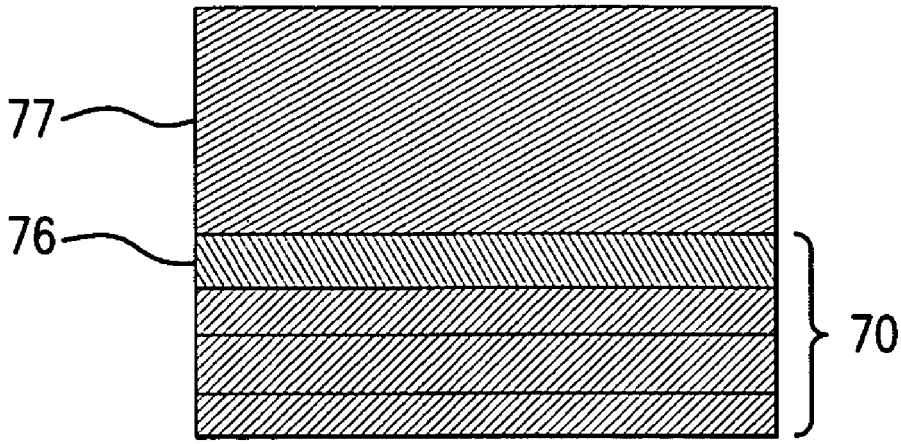
FIGS. 5A-5E schematically depict various steps of a method for fabricating the heating element having a nano-structured surface according to an embodiment of the present invention.

FIGS. 5A-5E depicts a more detailed illustration of the method for forming the heating element having the nano-structured surface discussed above. To simplify illustration, the substrate that supports the heating structure is omitted in FIGS. 5A-5E. Referring to FIG. 5A, the method starts with a multilayered heating structure 70 having an uppermost passivation layer 76 made of oxidizable refractory metal. In a preferred embodiment, the refractory metal is tantalum (Ta). An aluminum layer 77 is deposited on the Ta layer. It will be understood by those skilled in the art that the aluminum layer 77 may be substituted with an aluminum alloy such as an alloy having aluminum (Al) as the main component and a minor percentage of copper (Cu). From here onwards, the layer 77 is referred to as the Al layer. As an example, the Ta layer may have a thickness of about 300 to 500 nm and the Al layer may have a thickness of about 100 to 1,000 nm.

Figure 5B:
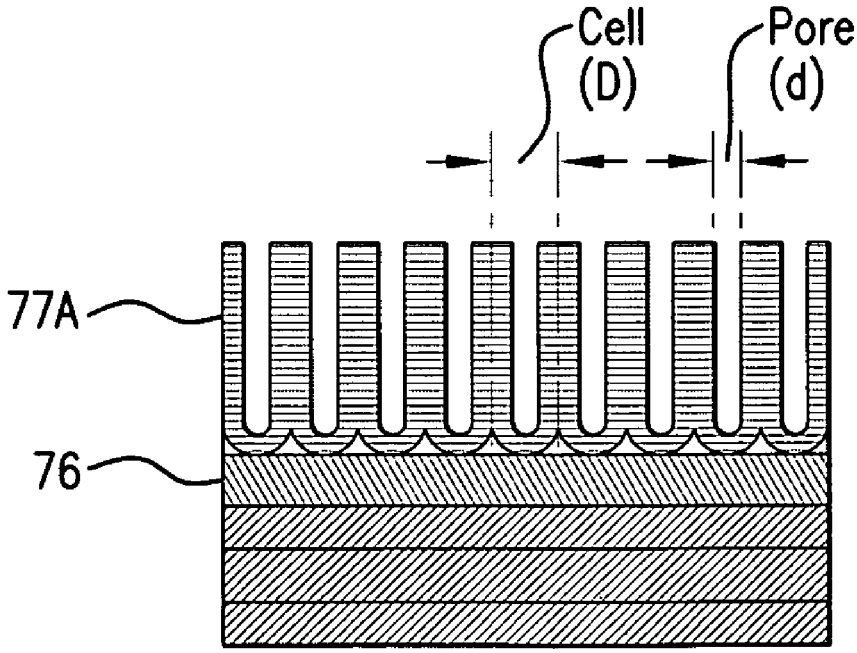
Figure 5C:
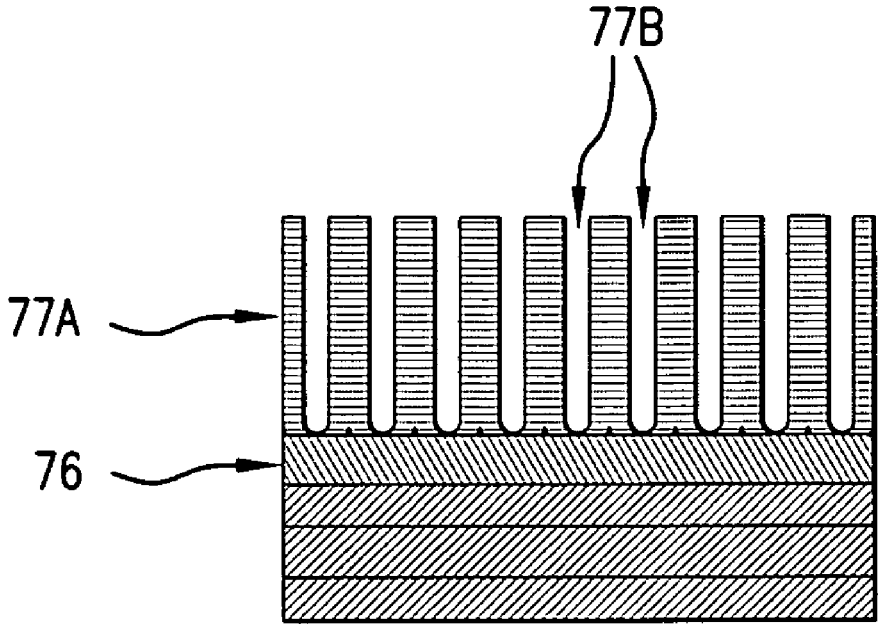

Referring to FIG. 5B, a first anodization process is carried out to anodize the Al layer so as to produce porous aluminum oxide 77A (i.e., anodic porous alumina, $Al_2O_3$). Anodization (i.e., electrochemical oxidation) is a well-known process for forming an oxide layer on a metal by making the metal the anode in an electrolytic cell and passing an electric current through the cell. For aluminum, current density during anodization should typically be kept about 0.5 milliamperes/$cm^2$ to 30 milliamperes/$cm^2$. Anodization can be performed at constant current (galvanostatic regime) or at constant voltage (potentiostatic regime). In the present case, the Al anodization process is carried out by exposing the Al layer to an electrolytic bath containing an oxidizing acid such as oxalic acid, phosphoric acid, sulfuric acid, chromic acid, or mixtures thereof. The voltage applied during the Al anodization process varies depending on the electrolyte composition. For example, the voltage may range from 5 to 25V for electrolyte based on sulfuric acid, 10-80V for electrolyte based on oxalic acid, and 50-150V for electrolyte based on phosphoric acid. In FIG. 5B, "D" represents the cell diameter of a cell in the porous alumina 77A, and "d" represents the pore diameter of a pore in the porous alumina. The anodization of the Al layer continues until the pores (i.e., nano holes) 77B extend through the thickness of the Al layer and expose portions of the underlying Ta layer 76, as illustrated in FIG. 5C.

Figure 5D:
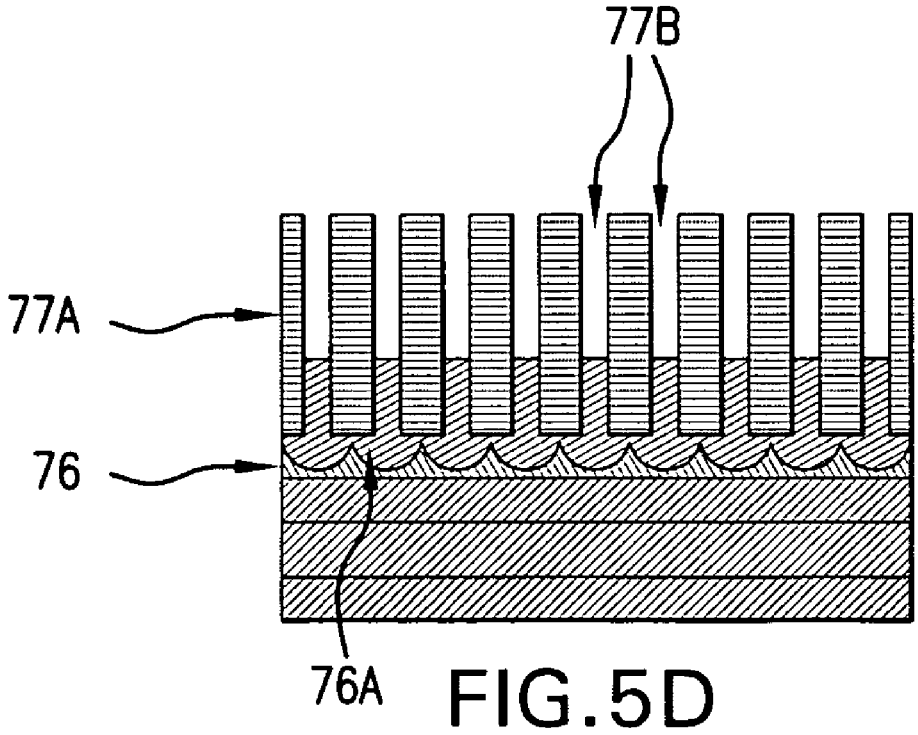
Figure 5E:
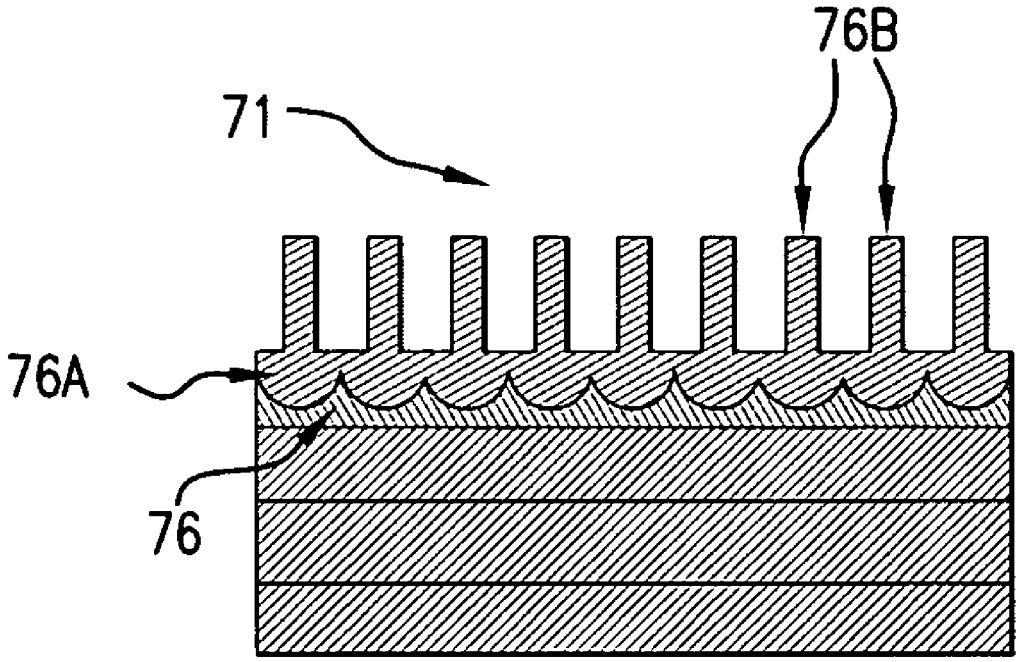

Referring to FIG. 5D, a second anodization process is carried out to partially anodize the underlying Ta layer 76 to thereby produce dense, anodic tantalum pentoxide ($Ta_2O_5$) material 76A that partially fills the pores 77B. Due to the significant expansion of the $Ta_2O_5$ as compared to Ta and the fact that the anodic $Ta_2O_5$ is dense, the pores 77B of the porous alumina 77A are filled from the bottom up. The expansion coefficient is defined as the ratio of $Ta_2O_5$ volume to consumed Ta volume. In this embodiment, the expansion coefficient is approximately 2.3 for the oxidation of Ta. Some residual Ta 76 remains below the anodic $Ta_2O_5$ 76 after the second anodization (FIG. 5D). The second anodization process may be carried out using the same electrolytic bath as that used in the first anodization process or a different one. The voltage applied for the Ta anodization process may range from 30V to 150V, but may be higher. The voltage for the second anodization depends on the final thickness of the anodized Ta and on the nature of the electrolyte being used. For some electrolytes, the voltage may be as high as 500V. Referring to FIG. 5E, the porous alumina is removed by selectively etching. In one embodiment, the selective etching step is performed using a selective etchant containing 92 g phosphoric acid ($H_3PO_4$), 32 g $CrO_3$ and 200 g $H_2O$, at approximately 95° C. for about 2 minutes. It will be understood by those skilled in the art that other selective etchants are also contemplated. After the completion of the selective etching step, a nano-structured surface 71 with an array of nano-pillars 76B results as illustrated in FIG. 5E. The array of nano-pillars 76B can be formed so that they are part of an anodic $Ta_2O_5$ layer 76A formed on a residual tantalum film 76. In an alternative embodiment, the nano-pillars can be formed so that they are attached to the residual Ta layer. Although tantalum has been disclosed as the material for the uppermost layer 76 in the preferred embodiment described above. It should be understood that, in alternative embodiments, other refractory metals such as Nb, Ti or W may be used.

Figure 6:
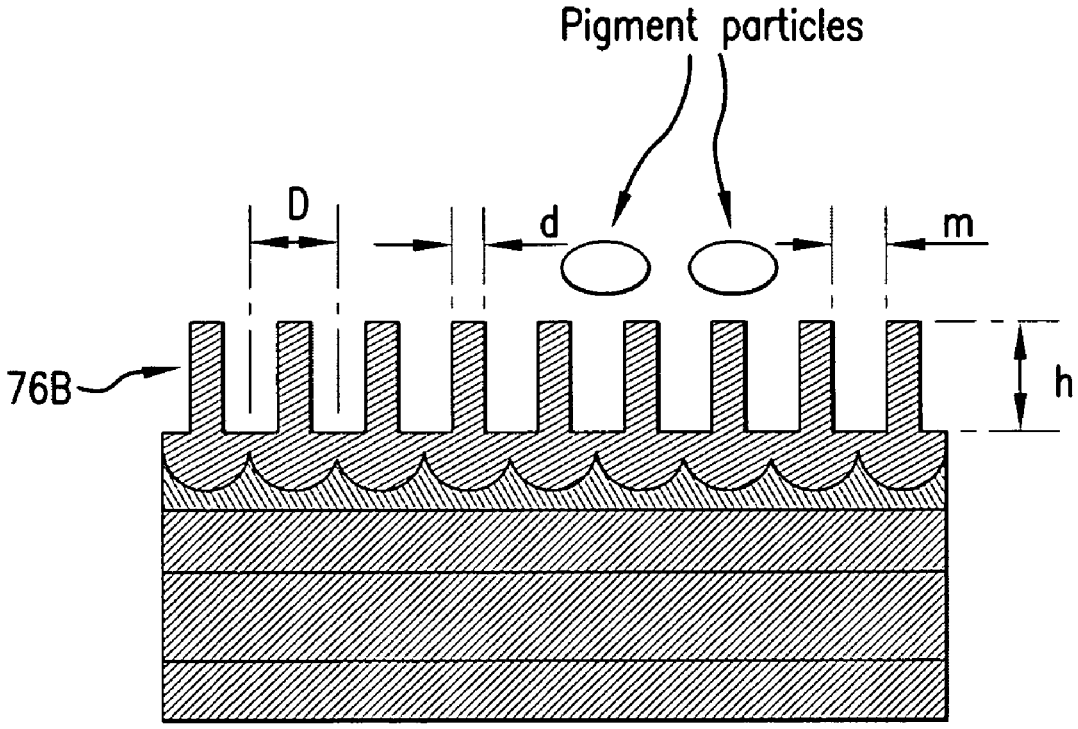
FIG. 6 shows a schematic, cross-sectional view of an array of nano-pillars produced by the method of the present invention.
Figure 7:
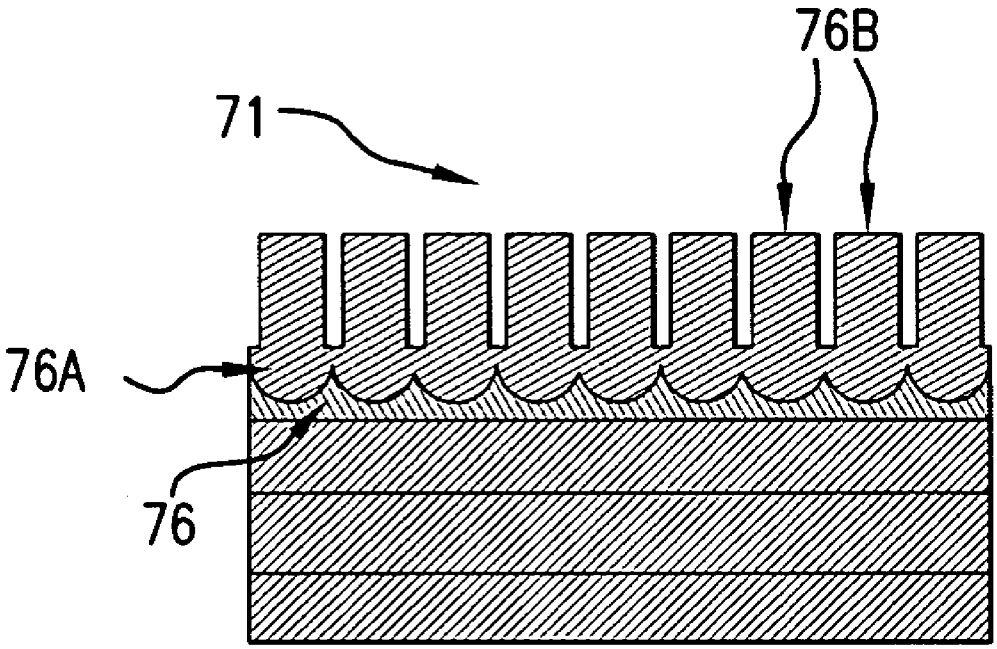
FIG. 7 shows a schematic, cross-sectional view of an array of nano-pillars having modified dimensions as compared to those shown in FIG. 5E.

The dimensions (diameter, pitch, the distance between nano-pillars and aspect ratio) of the nano-pillars can be easily controlled by the anodization processes and etching steps discussed above. FIG. 6 shows the dimensions of the nano-pillars that can be controlled. In FIG. 6, "D" represents the pitch of the nano-pillars, "d" represents the diameter of each nano-pillar, "m" represents the distance between the nano-pillars and "h" represents the height of the nano-pillars. The pitch D is equal to the distance between the pores in the porous anodic alumina, which is equal to the diameter of a cell of the porous anodic alumina (see FIG. 5B), and depends mainly on the anodization voltage. The diameter d is equal to a pore diameter of the porous anodic alumina and depends on the nature of the electrolyte, the current density during the anodization process as well as the degree of anisotropic etching of the porous alumina to widen the pores. Widening of the pores may be performed by using any conventional etchant. As an example, an etchant containing 5 wt % $H_3PO_4$ may be used. Depending on the required degree of pore widening, the etching temperature and time may be adjusted accordingly. The height h depends mainly on the anodization voltage. In general, the dimensions of the nano-pillars depend on the anodization voltage, the nature of the electrolytes, the duration of anodization, and the degree of selective etching. Due to the nature of the anodization process, these dimensions can be controlled so as to produce a pitch D in the range of 30 nm to 500 nm, and a diameter d in the range of 10 nm to 350 nm. However, the distance between the nano-pillars m should be smaller than the smallest particles in the ink to avoid any possibility for particles (e.g., pigment particles) to reach the 'base' of the nano-pillars. As examples, the distance between nano-pillars, m, should be smaller than 70 nm for 90 nm pigment particles and 120 nm for 150 nm particles. In a preferred embodiment, the distance between nano-pillars is 25%-30% smaller than the diameter of the smallest particles. FIG. 7 illustrates an embodiment with pitch D being the same as in FIG. 5E but with pore widening added. In this alternative embodiment, the pores in the anodic alumina are further widened by anisotropic etching using an etchant containing 5 wt % $H_3PO_4$ following Al anodization (FIG. 5C) but prior to the second anodization (FIG. 5D). When pore widening is added to the method described above with reference to FIGS. 5A-5E, the diameter of the nano-pillars become larger, thereby significantly reducing the distance between the nano-pillars.

In the case of the height h, the situation is different. It is more practical to control the aspect ratio "h/d" instead. The method of the present invention enables for a wide range of h/d aspect ratios, e.g., 10 or higher. In some cases, aspect ratios from 0.1 to 3 are sufficient for the intended purpose described herein and are easily achievable by the method of the present invention.

Pigment particles in the ink fluid supplied to the ink chamber are prevented from accumulating on the exposed, heating surface of the uppermost layer due to the presence of the nano-pillars described above. The distance between the nano-pillars, i.e. m, is controlled to be smaller than the diameter of the smallest pigment particles in the ink in order to prevent such particles from entering into the spacing. During resistive heating by the resistor 50, the solvent from the ink composition that has entered the spacing between the nano-pillars evaporates, and the solvent vapor causes the particles landing on the nano-pillars to move away from the heating surface of the uppermost layer, thereby resulting in cleaning of the heating surface. In addition, during resistive heating by the resistors 50, the temperature at the top part of the nano-pillars, the part that is in contact with the pigment particles, is lower than the temperature of the lower portion of the passivation layer 76. As a result, the effect of temperature on the Kogation process is minimized. As such, the heating element of the present invention is an improvement as compared to the conventional heating elements/resistors without nano-pillars. Without the nano-pillars, the pigment particles would stick to the exposed, heating surface of the heating elements/resistors, thereby resulting in the Kogation problem discussed above.

With proper dimensions, the array of nano-pillars effectively eliminates, or significantly minimize, the Kogation problem described earlier. The method for forming the nano-structured surface as described above provides a number of advantages including: simplicity in fabrication; low cost; the dimensions of the nano-pillars could be easily controlled; high reproducibility of the method due to the intrinsic nature of anodization; excellent uniformity of the nano-pillars; and the nano-pillars are made from the same material that already exist in the resistor region.

Although the present invention has been described with reference to certain representative embodiments, it will be understood to those skilled in the art that various modifications may be made to these representative embodiments without departing from the scope of the appended claims. More specifically, it will be understood by those skilled in the art that the present invention is applicable to other printhead configurations that are known in the art.

What is claimed is:

1. A printhead comprising at least one ink drop generator region, said ink drop generator region comprises:

an ink chamber for receiving an ink fluid containing particles;

an orifice through which ink drops are ejected; and a heating element formed on a substrate and positioned below the ink chamber, said heating element comprising a resistor defined therein and a nano-structured surface that is exposed to the ink fluid supplied to the ink chamber and said nano-structured surface takes the form of an array of metal oxide nano-pillars, and said nano-pillars are configured so as to have a distance between them that is smaller than the diameter of the smallest particles in the ink fluid.

2. The printhead of claim 1, wherein the metal oxide nano-pillars are formed by anodizing a refractory metal selected from a group consisting of tantalum (Ta), niobium (Nb), titanium (Ti), tungsten (W), and alloys thereof.

3. The printhead of claim 2, wherein said refractory metal comprises tantalum and the nano-pillars are formed of tantalum oxide derived from anodizing tantalum.

4. The printhead of claim 1, wherein said heating element is a multilayered structure having a resistive layer and a passivation layer as the uppermost layer, and said passivation layer has a nano-structured surface that is exposed to the ink fluid.

5. The printhead of claim 1, wherein said ink chamber is defined in a barrier layer which is formed over the heating element, and the orifice is formed in a nozzle plate, which is attached to the barrier layer so that the orifice, the ink chamber and the resistor are aligned.

6. A method for fabricating a printhead comprising:

providing a substrate;

forming a heating element on the substrate, said heating element comprising an oxidizable metal layer as an uppermost layer;

forming an aluminum-containing layer on the oxidizable metal layer;

anodizing the aluminum-containing layer to form porous alumina having nano pores that extend down to the oxidizable metal layer and expose portions of the oxidizable metal layer;

anodizing the oxidizable metal layer so as to partially fill the pores in the porous alumina from the bottom up with metal oxide material;

removing the porous alumina by selective etching to thereby yield a nano-structured surface, which takes the form of an array of metal oxide nano-pillars;

forming a barrier layer over the heating element, said barrier layer being configured to define an ink chamber disposed over the heating element, the ink chamber for receiving an ink fluid containing particles; and attaching a nozzle plate to the barrier layer, said nozzle plate including an orifice that is disposed over the ink chamber such that the orifice, the ink chamber and the heating element are aligned;

wherein said nano-pillars are configured so as to have a distance between them that is smaller than the diameter of the smallest particles in the ink fluid.

7. The method of claim 6, wherein forming the heating element comprises forming a multilayered structure having a resistive layer and an uppermost passivation layer as said oxidizable metal layer.

8. The method of claim 6, wherein the oxidizable metal is selected from the group consisting of tantalum (Ta), niobium (Nb), titanium (Ti), tungsten (W), and alloys thereof.

9. The method of claim 8, wherein the oxidizable metal is tantalum.

10. The method of claim 6, wherein anodizing the aluminum-containing layer comprises exposing the aluminum-containing layer to an electrolytic solution comprising an acidic electrolyte selected from a group consisting of oxalic acid, phosphoric acid, sulfuric acid, chromic acid, and mixtures thereof, and the oxidizable metal layer is anodized using an electrolyte that is the same as that used for anodizing the aluminum-containing layer.

11. The method of claim 6, wherein anodizing the aluminum-containing layer comprises exposing the aluminum-containing layer to an electrolytic solution comprising an acidic electrolyte selected from a group consisting of oxalic acid, phosphoric acid, sulfuric acid, chromic acid, and mixtures thereof, and the oxidizable metal layer is anodized using an electrolyte that is different from that used for anodizing the aluminum-containing layer.

12. The method of claim 6, wherein the selective etching of the porous alumina is carried out by wet etching using an etchant comprising phosphoric acid.

13. The method of claim 6, further comprising widening the nano pores in the porous alumina by anisotropic etching prior to anodizing the oxidizable metal layer.

* * * * *